US008608591B2

(12) United States Patent
Chao et al.

(10) Patent No.: US 8,608,591 B2
(45) Date of Patent: Dec. 17, 2013

(54) GOLF CLUB HEAD

(75) Inventors: Bing-Ling Chao, San Diego, CA (US); John Francis Lorentzen, El Cajon, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 374 days.

(21) Appl. No.: 12/974,437

(22) Filed: Dec. 21, 2010

(65) Prior Publication Data

US 2011/0159986 A1 Jun. 30, 2011

Related U.S. Application Data

(60) Provisional application No. 61/291,296, filed on Dec. 30, 2009.

(51) Int. Cl.
*A63B 53/04* (2006.01)

(52) U.S. Cl.
USPC ..... 473/345; 473/349

(58) Field of Classification Search
USPC ..... 473/324–350
See application file for complete search history.

(56) References Cited

U.S. PATENT DOCUMENTS 6,017,280 A * 1/2000 Hubert ..... 473/324
6,929,565 B2 * 8/2005 Nakahara et al. ..... 473/345
6,945,876 B2 * 9/2005 Nakahara et al. ..... 473/329
7,108,612 B2 * 9/2006 Nakahara et al. ..... 473/329
7,147,577 B2 * 12/2006 Nakahara et al. ..... 473/345
7,169,064 B2 * 1/2007 Nakahara et al. ..... 473/345
7,217,199 B2 * 5/2007 Nakahara et al. ..... 473/329
7,431,667 B2 * 10/2008 Vincent et al. ..... 473/345
7,435,190 B2 * 10/2008 Sugimoto ..... 473/345
7,549,935 B2 * 6/2009 Foster et al. ..... 473/335
7,637,822 B2 * 12/2009 Foster et al. ..... 473/329
7,691,008 B2 * 4/2010 Oyama ..... 473/345
7,717,806 B2 * 5/2010 Kubota ..... 473/340
7,749,097 B2 * 7/2010 Foster et al. ..... 473/329
7,846,038 B2 * 12/2010 Foster et al. ..... 473/329
7,931,546 B2 * 4/2011 Bennett et al. ..... 473/345
7,993,216 B2 * 8/2011 Lee ..... 473/334

* cited by examiner

*Primary Examiner* — Alvin Hunter
(74) *Attorney, Agent, or Firm* — Klarquist Sparkman, LLP

(57) ABSTRACT

A golf club head having good forgiveness and playability characteristics includes a body defining an interior cavity. The body includes a sole positioned at a bottom portion of the golf club head, a crown positioned at a top portion, a skirt positioned around a periphery between the sole and crown, and a strike face positioned at the front of the body. The body has a forward section, a mid-section and a back section. The mass of the forward section is at least as great as the combined mass of the mid-section and back section and the mass ratio of the back section to the mid-section is greater than 80%. Some embodiments of the club head include lightweight panels positioned within openings formed in the sole and crown of the body.

20 Claims, 6 Drawing Sheets

GOLF CLUB HEAD

CROSS REFERENCE TO RELATED APPLICATION

This application is a non-provisional application claiming priority to and benefit of provisional U.S. Patent Application No. 61/291,296, filed Dec. 30, 2009, which is incorporated herein by reference.

FIELD

The present application concerns golf club heads and, more particularly, golf club heads having high moments of inertia.

BACKGROUND

Golfers prefer golf clubs that exhibit performance characteristics such as forgiveness and playability. One measure of "forgiveness" can be defined as the ability of a golf club head to reduce the effects of mis-hits, e.g., hits resulting from striking the golf ball at a less than ideal impact location on the golf club head, on flight trajectory and shot distance. Greater forgiveness of the golf club head generally equates to a higher probability of hitting a straight golf shot. "Playability" can be defined as the ease with which a golfer can use the golf club head for producing accurate golf shots.

Golf club forgiveness is directly affected by the moments of inertia of the golf club head. A moment of inertia is a measure of a club head's resistance to twisting about the golf club head's center-of-gravity, for example on impact with a golf ball. In general, a moment of inertia of a mass about a given axis is proportional to the square of the distance of the mass away from the axis. In other words, increasing the distance of a mass from a given axis results in an increased moment of inertia of the mass about that axis. Higher golf club head moments of inertia result in lower golf club head rotation on impact with a golf ball, particularly on off-center impacts with a golf ball, e.g., mis-hits. Lower rotation in response to a mis-hit results in a player's perception that the club head is forgiving. Moreover, higher moments of inertia typically result in greater ball speed on impact with the golf club head, which can translate to increased golf shot distance.

United States Golf Association (USGA) regulations and constraints on golf club head shapes, sizes and other characteristics tend to limit the moments of inertia achievable by a golf club head. For example, the highest moment of inertia (Izz) allowable by the USGA is currently 5,900 $gcm^2$ (590 $kgmm^2$).

Because of increased demand by golfers to hit straighter and longer golf shots, golf club manufacturers have produced golf club heads that increasingly approach the maximum allowed moment of inertia (Izz). Although golf club heads with high moments of inertia (Izz) may provide greater left-to-right shot shape forgiveness, such benefits are contingent upon the golfer being able to adequately square up the club face prior to impacting the golf ball. For example, if the golf club head face is too open on impact with a golf ball, the ball will have a tendency to slice. The harder it is to rotate the golf club head during a swing, the more difficult it is to square the golf club head prior to impact with a golf ball and the greater the tendency to hit errant golf shots. Often, the bulkiness or size of a golf club head can negatively affect the ability of a golfer to rotate the golf club head into proper impact position. In other words, because the mass of bulkier golf club heads is distributed further away from the hosel and shaft, the moment of inertia about the shaft is increased making it harder to rotate the golf club head about the shaft during a swing.

Conventional golf club heads approaching the maximum allowable moment of inertia (Izz) tend to be bulkier than club heads with lower moments of inertia due to the outward extend of the periphery of the golf club head. Although the bulkiness of the golf club heads may provide a higher moment of inertia (Izz) for greater forgiveness, the golf club head makes it harder for a golfer to square up the golf club head. In other words, the high forgiveness of the golf club head can decrease the playability or other characteristics of the golf club head.

SUMMARY

This application describes golf club heads having high moments of inertia. In a preferred embodiment, the mass of the golf club head is concentrated in the face section. Preferably, the mass of the face section is greater than the mass of the mid-section and the back section combined and the mass ratio of the back section to the mid-section is greater than 80%.

In some embodiments, a golf club head having a total mass of 203 grams may have a face section mass of at least 120 grams, the mid-section mass may be between about 43 and 51 grams and the back section mass may be between about 30 and 37 grams. Such a golf club head may have a moment of inertia about the z-axis (Izz) of between 520 and 546 $kgmm^2$ and a moment of inertia about the x-axis (Ixx) of between 363 and 381 $kgmm^2$.

In some embodiments, the golf club head is provided with openings in a heavier structural material used to form the club head. Lightweight panels are placed in the apertures to create an enclosed club head and to allow greater discretion in the distribution of the mass of the golf club head. Preferably, the panels are fitted within openings formed in the sole, crown or both of the golf club head.

In some embodiments the panels may be made of a composite material such as a carbon fiber epoxy resin or carbon fiber reinforced plastic.

The foregoing and other objects, features, and advantages of the invention will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

DETAILED DESCRIPTION

Figure 1:
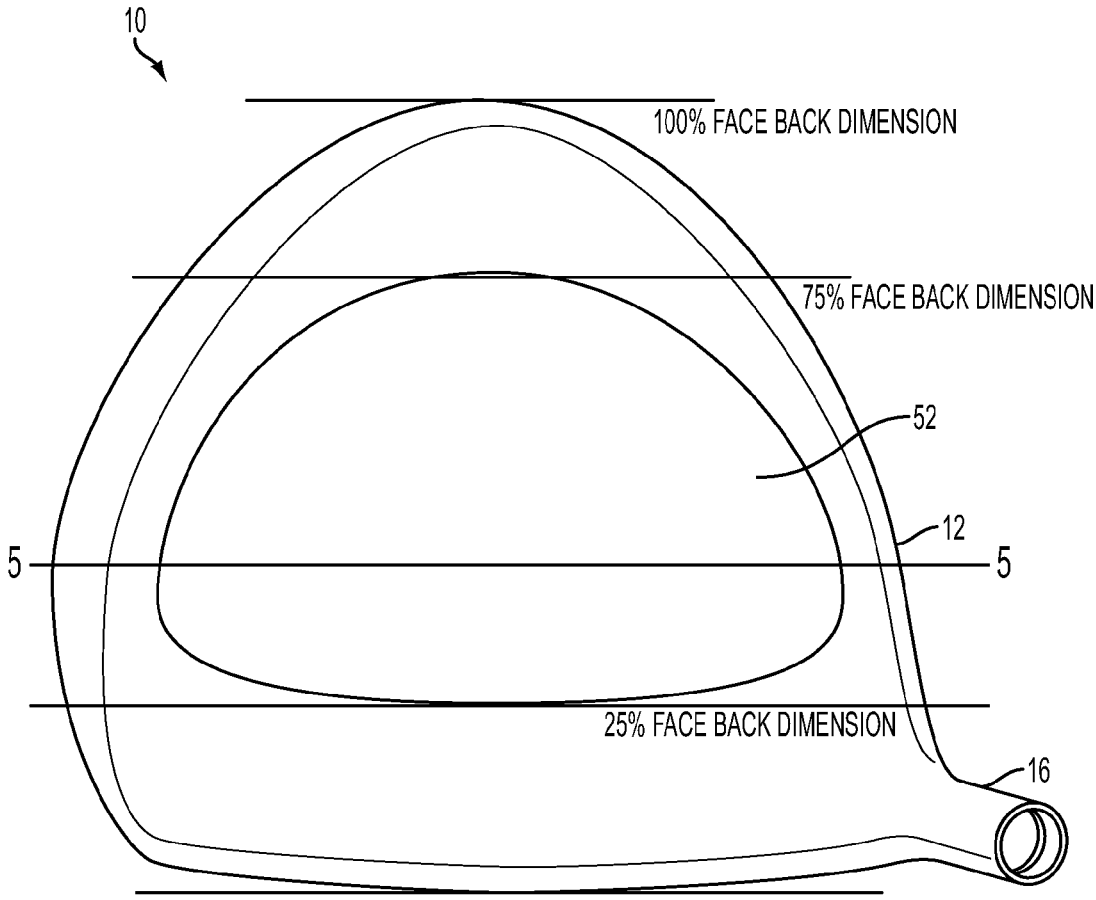
FIG. 1 is a top view of a golf club head according to an embodiment.
Figure 2:
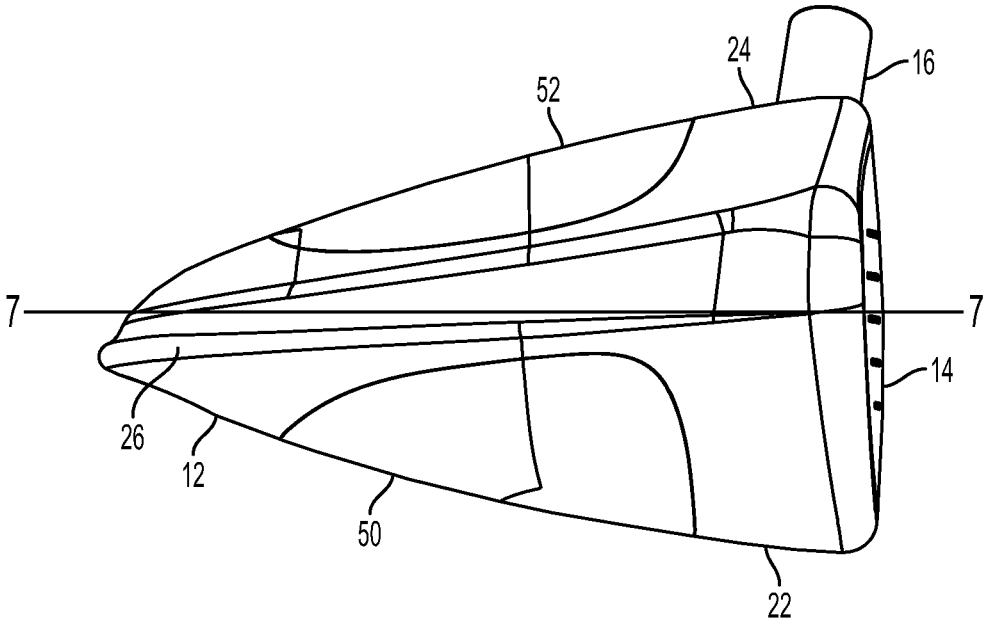
FIG. 2 is a side view of the golf club head of FIG. 1.
Figure 3:
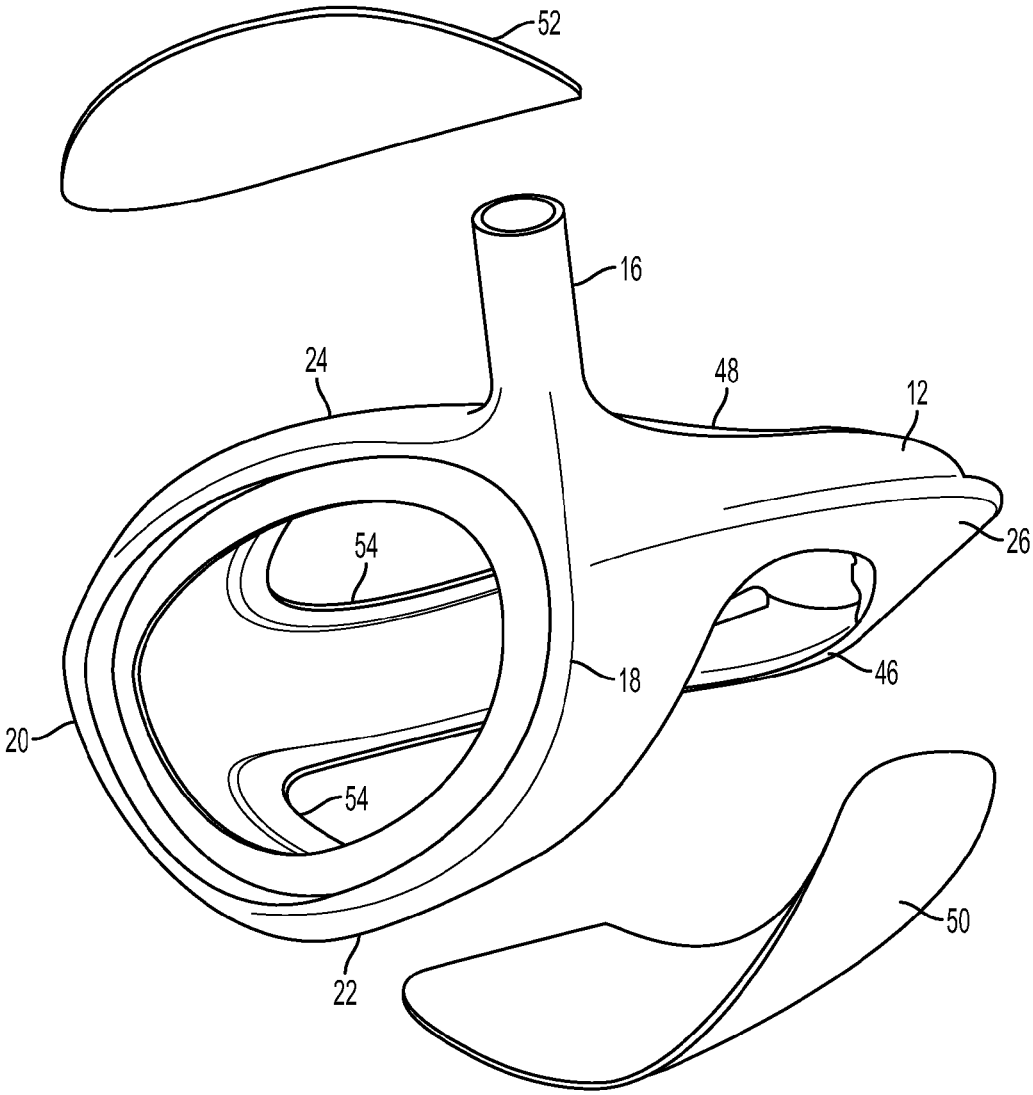
FIG. 3 is a perspective, partially exploded view of the golf club head of FIG. 1 with the strike plate removed.
Figure 4:
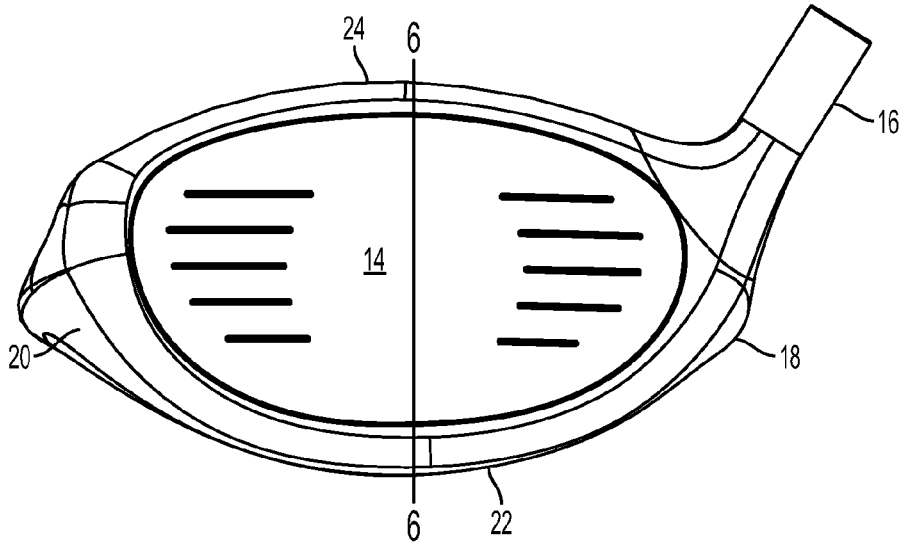
FIG. 4 is a front view of the golf club head of FIG. 1.
Figure 5:
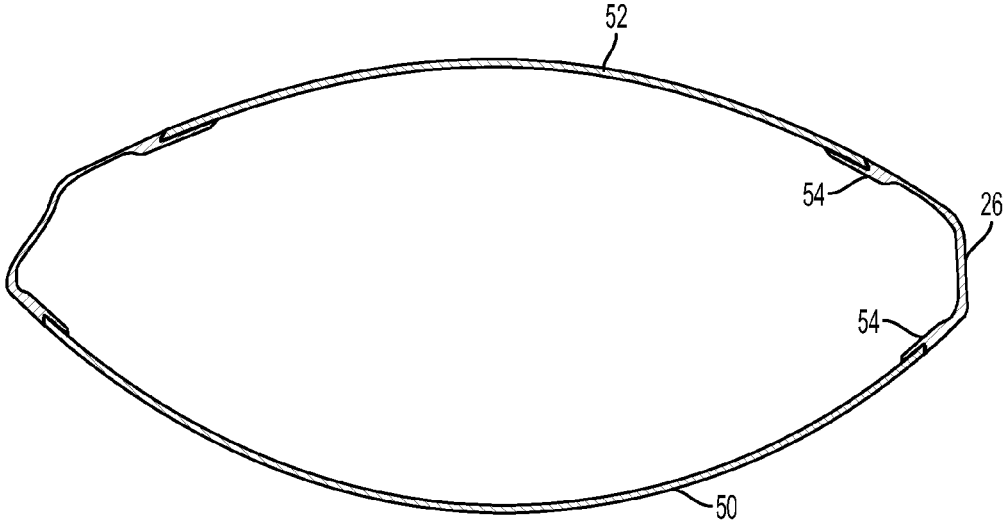
FIG. 5 is a front cross-sectional view taken along line 5-5 in FIG. 1.
Figure 6:
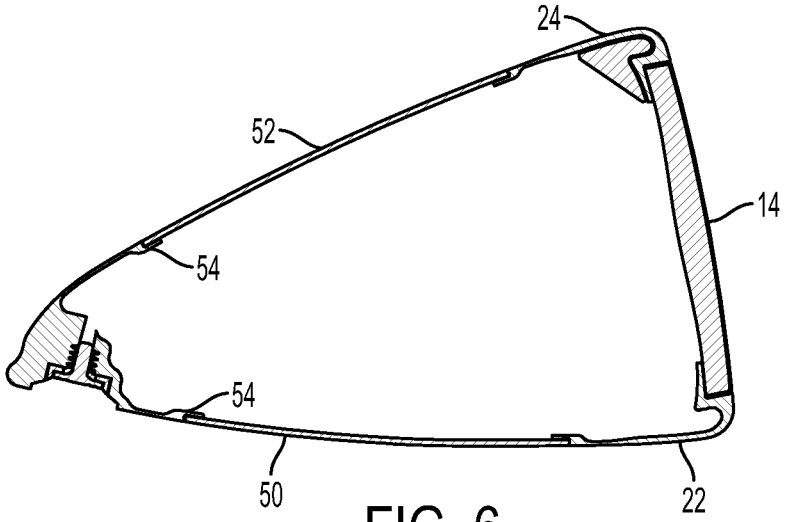
FIG. 6 is a side cross-sectional view taken along line 6-6 in FIG. 4.
Figure 7:
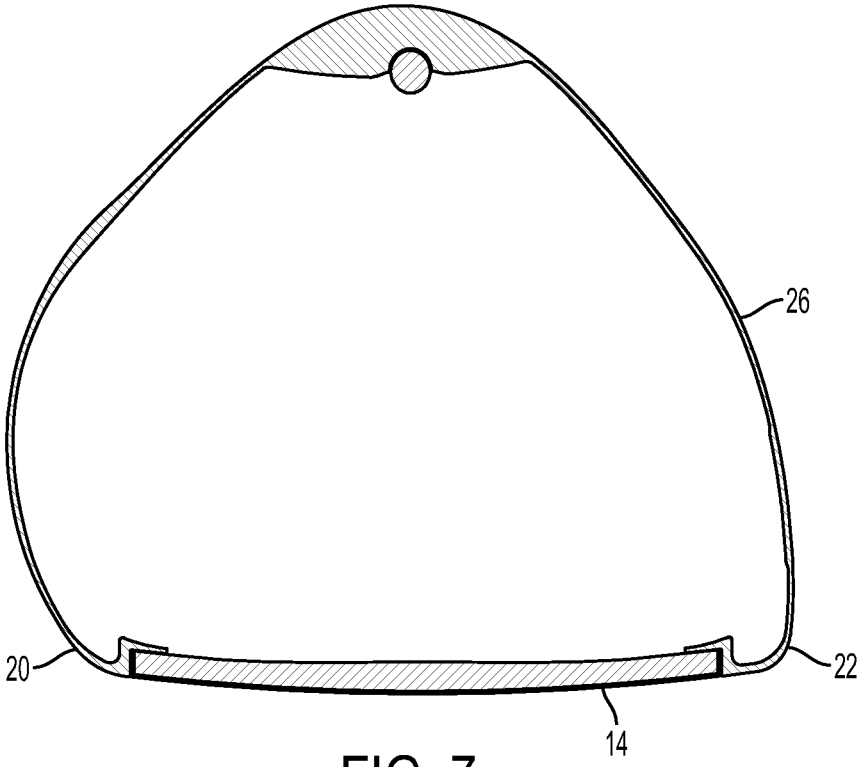
FIG. 7 is a top cross sectional view taken along line 7-7 in FIG. 2.

Embodiments of a golf club head providing increased moments of inertia ("MOI") are described herein. Club heads and many of their physical characteristics disclosed herein will be described using "normal address position" as the club head reference position, unless otherwise indicated. Thus, directional terms such as top, bottom, front, back and the like will refer to the club head as positioned in normal address position with the surface that strikes the ball being the front surface.

A golf club head is in its normal address position when the angle defined between a face plane, defined as the plane tangent to an ideal impact location on the striking surface, and a vertical plane relative to the ground is approximately equal to the golf club head loft, and when the golf club head lie angle, the angle defined between a longitudinal axis of the hosel or shaft and the ground, is approximately equal to 60 degrees. The ground, as used herein, is assumed to be a level plane.

An exemplary metal-wood golf club such as a fairway wood or driver typically includes a hollow shaft having a lower end to which a hollow club head is attached. As illustrated in FIGS. 1-7, the club head 10 comprises a hollow body 12 to which a strike plate, or face plate, 14 is attached or integrally formed. The body 12 includes a hosel 16 that extends generally upward and is connected to the shaft of the club. The body 12 also includes a heel region 18 situated close to the hosel 16, a toe region 20 situated opposite the heel region 18, a sole (lower) region 22, and a crown (upper) region 24. A skirt portion 26 extends around the periphery of the club head 10, between the sole 22 and the crown 24 and excluding the strike plate 14. The body 12 bears most of the impact load imparted to the strike plate 14 when the club head 10 strikes a golf ball. The strike plate 14 defines a front surface or strike face that actually contacts the golf ball.

The body 12 is preferably made of a metal alloy (e.g., an alloy of titanium, an alloy of steel, an alloy of aluminum, and/or an alloy of magnesium), but could also be made of a composite material, such as a graphitic composite, a ceramic material, or any combination thereof. The crown 24, sole 20, and skirt 26 can be integrally formed using techniques such as molding, cold forming, casting, and/or forging. The strike plate 14 can be integrally formed with the body or may be a separate piece attached to the body. The strike plate 14 can be made of a composite material, metal alloy, (e.g., titanium, steel, aluminum, and/or magnesium), ceramic material, or a combination of composite, metal alloy, and/or ceramic materials. Further, the strike plate 14 can have a variable thickness.

The mass of the club head is distributed so as to improve the forgiveness and other characteristics of the head. Forgiveness on a golf shot is generally maximized by configuring the golf club head such that the center of gravity ("CG") of the golf club head is optimally located and the MOI of the golf club head is maximized. Various different MOI values may be utilized to characterize a golf club. For example, MOI about the vertical axis (Izz) and MOI about the heel-toe axis (Ixx).

Golf club head moments of inertia are typically defined about three axes extending through the golf club head CG: (1) a CG z-axis extending through the CG in a generally vertical direction relative to the ground; (2) a CG x-axis extending through the CG in a heel-to-toe direction generally parallel to the strike plate 14 and generally perpendicular to the CG z-axis; and (3) a CG y-axis extending through the CG in a front-to-back direction and generally perpendicular to the CG x-axis and the CG z-axis. The CG x-axis and the CG y-axis both extend in a generally horizontal direction relative to the ground when the club head is at the normal address position. Typically, however, the MOI about the z-axis (Izz) is most relevant to club head forgiveness. The MOI about the x-axis (Ixx) is of lesser importance, and the MOI about the y-axis has even less influence on golf club forgiveness.

A moment of inertia about the golf club head CG x-axis is calculated by the following equation:

$$Ixx=\int(y^2+z^2)dm \tag{1}$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CG x-axis and the golf club head CG y-axis.

Similarly, a moment of inertia about the golf club head CG z-axis is calculated by the following equation:

$$Izz=\int(x^2+y^2)dm \tag{2}$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

To achieve higher MOIs, club heads can be made as large as possible and the mass of the club head can be distributed, as much as possible, strategically around the periphery of the club head and rearward of the face plate. The total mass of the club head can be considered the club head's "mass budget." It is axiomatic that at least some of the mass be dedicated to achieving the required strength and structural support of the club head. This is termed "structural" mass. Any mass remaining in the budget is called "discretionary" or "performance" mass, which can be distributed about the club head to maximize performance. Mass shift, properly executed, may be able to maximize Izz and Ixx together, rather than sacrificing one for the sake of the other.

One way to shift mass away from the center of gravity is to make the club head larger. This can be done without increasing the overall mass of the club head by making the walls of the body thinner. Of course, there is a limit to how thin the walls may be without compromising the structural integrity of the club head. Further, increasing the size of a club head may present other drawbacks. For example, it may adversely affect the playability of the club. Likewise, shifting mass may also shift the CG of the club head and affect performance of the club head. Therefore, there may be tradeoffs associated with increasing a club head's MOIs.

One way to measure mass distribution is to refer to the mass found in various regions of the club head. For example, the club head can be divided into a face section, a mid-section and a back section. The mass of each section can then be analyzed and adjusted during the design process.

Figure 8:
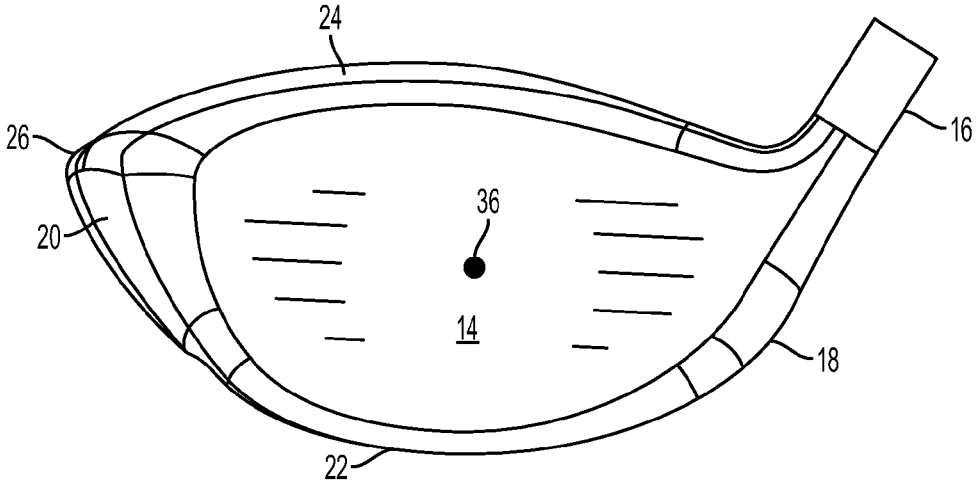
FIG. 8 illustrates a portion of a method for determining the face section according to an embodiment.
Figure 9:
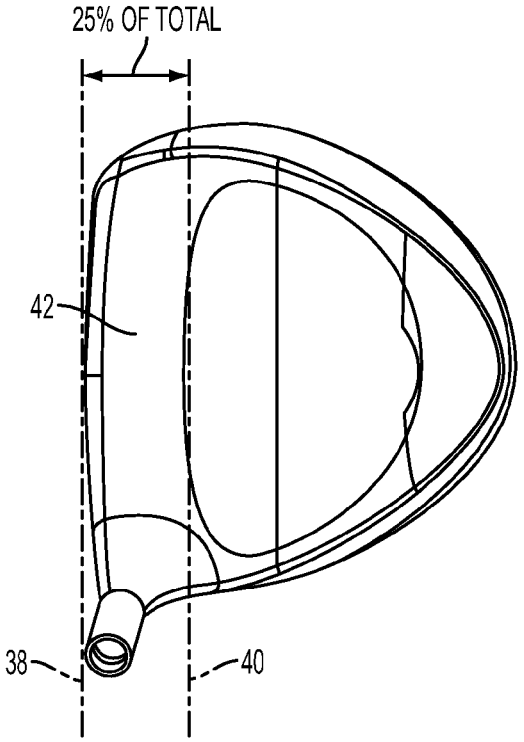
FIG. 9 is a top view illustrating the cut planes defining the face section of the club head.

For purposes of this disclosure, the face section of a golf club head is determined in the following manner, described with reference to a club head for a metal-wood as shown in FIGS. 8-9.

The face center 36 of the strike plate 14 is located using a method as described in the USGA pendulum test ("Procedure for Measuring the Flexibility of a Golf Clubhead," Rev. 2.0, Mar. 25, 2005). A typical face center 36 is shown in FIG. 8. Turning now to FIG. 9, a tangent plane 38 is defined as being tangent to the strike plate 14 at the face center 36. A second cut plane 40 is defined as being parallel to the tangent plane 38 but located 25% of the total length of the club head rearward of the tangent plane, as shown in FIG. 9.

The club head can be cut along the second cut plane 40 (FIG. 9) to remove the front section 42 from the rest of the club head. The front section can be used to determine the mass contained in the front section 42.

A back section of the club head 10, for determining the mass of the back section, can be obtained in a similar manner. A third cut plane 44, illustrated best in FIG. 1, is defined parallel to the second cut plane at a distance of 75% of the total club head length behind the strike face 14 (or 50% of the club head length behind the second cut plane 40).

The remainder of the club head 10, after the face section and back section have been removed, is the mid-section. The mid-section can be used to determine the mass contained in the mid-section.

The golf club heads of this disclosure have a mass distribution such that the mass of the face section is at least as great as the combined mass of the mid-section and back section and the mass ratio of the back section to the mid-section is greater than 80%. In some embodiments, the mass of the mid-section is approximately equal to the mass of the back section. Table 1, below, sets forth exemplary mass distribution of a club head of the type illustrated in FIGS. 1-7 (example 1) compared with other club heads having uni-material constructions (examples 2 and 3).

TABLE 1

| Example | Total Mass (g) | Izz ($kgmm^2$) | Ixx ($kgmm^2$) | Face Section Mass (g) | Mid-Section Mass (g) | Back Section Mass (g) | Mass Ratio of Back to Mid Section |
|---|---|---|---|---|---|---|---|
| 1 | 202.8 | 546.0 | 381.0 | 122.1 | 43.2 | 37.5 | 86.8% |
| 2 | 202.7 | 519.0 | 363.0 | 121.6 | 47.8 | 33.3 | 69.7% |
| 3 | 203.1 | 515.0 | 355.0 | 122.2 | 50.6 | 30.3 | 59.9% |

Examples 2 and 3 in Table 1 are golf club heads with cast, thin wall titanium bodies. Example 1 in Table 1 is a golf club head similar to Example 2, but with portions of the crown and sole replaced with carbon fiber composite material panels.

The mass of the club head can be shifted and distributed using a variety of known methods to obtain the desired relationship between the masses of the face, mid- and rear sections while maintaining the structural integrity of the club head.

One technique that can assist in mass distribution is to form one or more openings in the walls of the golf club head body. Because it is typically desirable for the body to be enclosed, a lightweight panel can be positioned within each opening to close the opening. By selecting a material for the panels that is less dense than the material used to form the club head body the difference between the mass of the body material that would otherwise occupy the opening and the panel can be positioned elsewhere on the club head. By strategically selecting the number, size and location of the openings, a substantial increase in the club head's MOI's can be achieved.

A golf club head having such panels is illustrated in FIGS. 1-7. In the illustrated embodiment, a sole opening 46 is formed in the sole region 22 and a crown opening 48 is formed the crown region 24 of the body 12. The size and shape of each opening may vary from one golf club to another, and are typically selected to allow the size of the opening to be as large as possible without compromising the structural integrity of the club head. In the illustrated embodiment, the openings are contained largely within the mid-section of the club head.

A sole panel 50 is associated with the sole opening and has a corresponding size and shape. In this manner, the sole panel 50 can be positioned within the sole opening 46 to close the opening. A lip 54 can be formed around the sole opening 46 on the interior side of the body 12 to facilitate attachment of the sole panel 50 within the opening. The panel may be attached using adhesive or any other suitable technique.

Likewise, a crown panel 52 is associated with the crown opening 48 and has a corresponding size and shape. In like manner, the crown panel 52 can be positioned within the crown opening 48 to close the opening.

In the illustrated embodiment, the panels have thickness in the range of 0.6-1.0 mm, for example, and may be made from carbon fiber epoxy resin, carbon fiber reinforced plastic, polyurethane or quasi-isotropic composites, as a few examples. However, other materials that provide sufficient strength, durability and reduced weight may be employed in other embodiments.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense. Rather, the scope of the invention is defined by the following claims. We therefore claim as our invention all that comes within the scope and spirit of these claims.

We claim:

1. A golf club head, comprising:

a body defining an interior cavity, a sole portion positioned at a bottom portion of the golf club head, a crown portion positioned at a top portion, and a skirt portion positioned around a periphery between the sole and crown, the body also having a face section, a mid-section and a back section; and a face plate positioned at the forward portion of the body, wherein, the mass of the front section of the club is at least as great as the combined mass of the mid-section and back section and the mass ratio of the back section to the mid-section is greater than 80%, wherein the body defines at least one opening and further comprising one or more panels, each panel positioned within and closing one of the one or more openings.

2. The golf club of claim 1 wherein the one or more panels are made of a material having a lower density than the body.

3. The golf club head of claim 2 wherein one of the at least one or more openings is located in the crown portion.

4. The golf club head of claim 2 wherein one of the at least one or more openings is location in the sole portion.

5. The golf club head of claim 2 wherein there are two openings, one formed in the crown portion and one formed in the sole portion and wherein there are two panels, one positioned in each opening to close the opening.

6. A golf club head, comprising:

a body defining an interior cavity, a sole portion positioned at a bottom portion of the golf club head, a crown portion positioned at a top portion, and a skirt portion positioned around a periphery between the sole and crown, the body also having a face section, a mid-section and a back section, the body further defining one or more openings;

one or more panels, each panel corresponding to one of the one or more openings, each panel located within its corresponding opening to close the opening, and each panel having a density less than the density of the body; and a face positioned at the forward portion of the body, wherein, the mass of the front section is at least as great as the combined mass of the mid-section and back section and the mass ratio of the back section to the mid-section is greater than 80%.

7. The golf club head of claim 6 in which one of the one or more openings is formed in the sole portion.

8. The golf club head of claim 6 in which one of the one or more openings is formed in the crown portion.

9. The golf club of head of claim 6 in which there are two opening and two panels, one opening in the mid-section of the sole portion and the other opening in the mid-section of the crown portion.

10. The golf club head of claim 9 in which the total mass of the golf club head is approximately 203 grams and the mass of the face section is between approximately 110 and 130 grams.

11. The golf club head of claim 10 in which the mass of the mid-section is between approximately 43 and 50 grams.

12. The golf club head of claim 10 in which the mass of the back section is between approximately 31 and 52 grams.

13. The golf club head of claim 9 in which Izz is between about 520 and 590 kg-mm$^2$.

14. The golf club head of claim 9 in which Ixx is between about 359 and 425 kg-mm$^2$.

15. A golf club head having high moments of inertia, comprising:

a body defining an interior cavity, the body having a sole with a first opening formed therein, a crown with a second opening formed therein and a face plate, a first panel having a shape corresponding with the first opening and positioned within the first opening to close the first opening; and a second panel having a shape corresponding with the second opening and positioned within the second opening to close the second opening;

wherein the first panel and the second panel are made from a material having a density less that the density of the body, and wherein the mass of the face section of the golf club head is at least as great as the combined mass of the mid-section and back section and the mass ratio of the back section to the mid-section is greater than 80%.

16. The golf club head of claim 15 in which the total mass of the golf club head is approximately 203 grams and the mass of the face section is between approximately 110 and 130 grams.

17. The golf club head of claim 15 in which the mass of the mid-section is between approximately 43 and 50 grams.

18. The golf club head of claim 15 in which the mass of the back section is between approximately 31 and 52 grams.

19. The golf club head of claim 15 in which Izz is between about 520 and 590 kgmm$^2$.

20. The golf club head of claim 15 in which Ixx is between about 359 and 425 kgmm$^2$.

* * * * *